US005970888A

United States Patent [19]

Sheppard

[11] Patent Number: 5,970,888

[45] Date of Patent: Oct. 26, 1999

[54] BANK TELLER STATION

[75] Inventor: Robert R. Sheppard, Richmond, Va.

[73] Assignee: Security Corporation, Richmond, Va.

[21] Appl. No.: 09/001,088

[22] Filed: Dec. 30, 1997

[51] Int. Cl.[6] ..... E06B 7/32

[52] U.S. Cl. ..... 109/10; 109/19

[58] Field of Search ..... 109/10, 19

[56] References Cited

U.S. PATENT DOCUMENTS

| | | | |
|---|---|---|---|
| 1,648,891 | 11/1927 | Beersman | 109/10 |
| 1,663,681 | 3/1928 | Cronenweth | 109/10 X |
| 1,840,980 | 1/1932 | Schulz | 109/19 |
| 1,977,719 | 10/1934 | Forsell | 109/10 |
| 2,722,179 | 11/1955 | Belew | 109/19 |
| 2,730,053 | 1/1956 | Ellithorpe | 109/19 |
| 2,912,066 | 11/1959 | Ellithorpe . | |
| 2,949,870 | 8/1960 | Graber . | |
| 2,984,194 | 5/1961 | Jennings | 109/19 |
| 3,294,342 | 12/1966 | McClure et al. . | |
| 3,298,329 | 1/1967 | Carstens, Jr. et al. | 109/10 |
| 3,876,864 | 4/1975 | Clark et al. . | |
| 3,880,345 | 4/1975 | Becker et al. | 109/19 X |
| 4,294,380 | 10/1981 | Rankin | 221/195 |
| 4,372,225 | 2/1983 | Tissot et al. | 109/19 |
| 4,429,639 | 2/1984 | Burchart | 109/19 |
| 4,662,288 | 5/1987 | Hastings et al. | 109/10 X |
| 4,703,347 | 10/1987 | Yasuda et al. | 358/102 |
| 4,953,326 | 9/1990 | Wexler et al. | 52/33 |
| 5,168,354 | 12/1992 | Martinez et al. | 358/93 |
| 5,205,224 | 4/1993 | Durst | 109/19 |
| 5,615,624 | 4/1997 | Terry et al. | 109/19 |

FOREIGN PATENT DOCUMENTS

| | | | |
|---|---|---|---|
| 788747 | 7/1968 | Canada | 109/19 |
| 8602317 | 9/1986 | Netherlands | 109/10 |

*Primary Examiner*—Lloyd A. Gall
*Attorney, Agent, or Firm*—J. Michael Martinez de Andino; McGuire, Woods, Battle & Boothe LLP

[57] ABSTRACT

A modular bank teller station wherein a single teller can provide banking service to a plurality of banking customers, including a frame having a plurality of interconnected wall members attached thereto to define a bank teller control area isolated from a plurality of customer receiving areas. A communications system is provided for visual and audible communication between the teller and the customer. For transaction of banking business a tray system is provided which will allow the transfer of bank transaction material between the teller and the customer while keeping the tray access openings covered in the absence of a tray.

30 Claims, 10 Drawing Sheets

BANK TELLER STATION

BACKGROUND OF THE INVENTION

The present invention relates broadly to static structures, namely, buildings and associated substructures dedicated to a specific purpose. More particularly, the present invention relates to a bank teller station providing enhanced security for bank personnel and that is easily installed when constructing a bank or otherwise installing banking facilities in an existing structure.

Typically, bank teller stations will exist as designated areas of an elongate counter top with several teller stations aligned in a row. Each teller will transact business with a single customer across the counter top. In some situations, a row of vertically oriented bars will separate the teller area from the customer area or, in other situations, a window may be installed. Generally, the teller is exposed to the lobby area.

Most modern banking facilities also include automatic teller machines which will accept deposits and otherwise conduct banking business without the involvement of a human teller. Nevertheless, most banking customers would rather transact business, especially with regard to deposits, during a one-on-one exchange with a live human teller.

Drive-through banking represents an intermediate position between automatic teller machines and counter top transactions. There, the teller is typically located behind a thick glass window and transaction materials are transported between the customer and the teller using pneumatic tubes through which cylindrical capsules travel containing the transaction materials. A microphone and speaker system is typically employed for voice communication between the teller and the customer. Sometimes the customer can see the teller across the drive-through area or, if the customer is at the window, the customer can see the teller therethrough.

Teller security, quite obviously, is greatest with an automatic teller machine due to the fact that no teller is involved. Secondly, the drive-through situation provides some teller security while providing an intermediate level of teller/customer interaction. Nevertheless, the burden is on the customer to conduct banking business from within an automobile. Teller security is almost completely compromised with the in-bank counter top face-to-face transaction system. During the transaction process, the teller is almost completely vulnerable to the whims of the customer and, should the customer turn out to be a thief, the teller may then be placed in danger. The threat is enhanced if the thief is armed.

Therefore, there exists a need for a bank teller station wherein a teller can provide personalized service and yet maintain the safety of the teller and the bank's funds. Further, since a teller will typically deal with one customer at a time, it would be advantageous to provide a teller station which could serve multiple customers easily when attended by a single teller.

SUMMARY OF THE INVENTION

It is accordingly an object of the present invention to provide a bank teller station which provides enhanced teller security while providing the ability for the teller to personally serve banking customers.

It is another object of the present invention to provide such a bank teller station which will serve as multiple customers using a single teller.

It is another object of the present invention to provide such a bank teller station which is modular in nature to allow the station to be easily installed when setting up a bank.

To those ends, and according to the preferred embodiment of the present invention, a bank teller station is provided wherein a single bank teller can provide banking services to a plurality of banking customers with the bank teller station providing enhanced security for the bank teller. The bank teller station according to the present invention includes a plurality of interconnected wall members defining a bank teller control area and a plurality of customer receiving areas, the wall members including at least one isolation wall member disposed intermediate the bank teller control area and the plurality of customer receiving areas to thereby isolate the teller control area from the plurality of customer receiving areas. Further, the present invention includes an arrangement for enabling communication between a teller at the teller control station and a customer at one of the plurality of customer receiving areas, the communication enabling arrangement being mounted to the wall members; at least one tray support mounted to the wall members intermediate the teller control area and the plurality of customer receiving areas; and a plurality of transaction trays corresponding in number to the plurality of customer receiving areas, the transaction trays being movably disposed on the tray support for controlled movement between the first position at the teller control area and a second position at a respective one of the plurality of customer receiving areas to allow the interchange of transactional material between the bank teller control area and the plurality of customer receiving areas, the at least one isolation wall member having a first access opening formed therein at the bank teller control area and a plurality of second access openings formed therein at the plurality of customer receiving areas with each of the access openings being in communication with a respective transaction tray. Also included is an assembly for moving the transaction trays between the first position at the teller control area and the second position at a respective one of the plurality of customer receiving areas with the assembly for moving the transaction trays being disposed within the confines of the wall members. The present invention further includes a plurality of cover members movably mounted to the teller station adjacent the access openings with the cover members being selectively movable in and out of covering relation with the access openings; an assembly for moving the cover members in and out of covering relation with the access openings; and an assembly for selectively controlling movement of the transaction trays, the assembly for selectively controlling movement being mounted to the wall members at the teller control area and operable therefrom.

It is preferred that the wall members define two customer receiving areas disposed adjacent to one another and in facing relation with the teller control area and separated therefrom by at least one isolation wall member and being isolated from one other by a customer isolation wall disposed intermediate the customer receiving areas. It is preferred that at least one isolation wall member be resistant to penetration by bullets. Preferably, the bank teller station includes at least two isolation walls, both isolation walls being disposed intermediate the bank teller control area and the plurality of customer receiving areas with a spacing defined between the isolation wall members to thereby further isolate the teller control area from the plurality of customer receiving areas.

It is preferred that the present invention include an arrangement disposed in the customer receiving areas to alert a teller at the teller control area. It is also preferred that the arrangement for enabling communication between a teller at the teller control station and a customer at one of the plurality of customer receiving areas includes a teller voice communication device disposed at the teller control area and a plurality of customer voice communication devices, each of the plurality being disposed at a respective one of the customer receiving areas, the teller voice communication device being in communication with each of the customer voice communication devices for selective voice communication between a teller and a customer. Preferably, the arrangement for enabling communication between a teller at the teller control station and a customer in one of the plurality of customer receiving areas includes a teller camera disposed in the teller control area and a plurality of monitors in communication with the teller camera with one of the plurality of monitors being disposed at one of the plurality of customer receiving areas for viewing of a teller by a customer. Further, the arrangement for enabling communication between a teller at the teller control station and a customer in the one of the plurality of customer receiving areas includes a plurality of customer cameras with each of the plurality of cameras being disposed in a respective one of the customer receiving areas, and at least one monitor in communication with the customer cameras with the at least one monitor being disposed at the teller control area for viewing a customer by a teller.

Preferably, the tray support includes at least one rail extending between the access openings and the transaction trays are slidably mounted to the at least one rail. It is preferred that the assembly for moving the transaction trays between the first position at the teller control area and the second position at a respective one of the plurality of customer receiving areas includes a plurality of endless strand members, each attached to a respective one of the plurality of trays and an assembly for individually moving the plurality of endless strand members and thereby individually moving the transaction trays. Preferably, the assembly for moving the transaction trays includes at least one electric motor in mechanical communication with the strand members so that excitement of the at least one electric motor causes movement of at least one of the endless strand members and the at least one electric motor is selectively operable for selective movement of the transaction trays. It is preferred that the assembly for selectively controlling movement of the transaction trays include a motor activation switch disposed at the teller control area in electrical communication with the at least one electric motor for teller initiated movement of the transaction trays.

It is preferred that the assembly for moving the cover members in and out of covering relation with the access openings includes an arrangement for connecting a respective one of the cover members to a respective transaction tray for simultaneous movement thereof to move each cover member in to and out of covering relation with each access opening and an arm pivotally mounted to the tray support adjacent to each access opening with the arm being displaceable by one of the transaction trays as the transaction tray attains a predetermined distance from the access opening to abut the cover member and disengage the cover member from the transaction tray, thereby leaving the cover member in covering relation with a respective one of the access openings.

Preferably, the tray support includes at least one longitudinally extending rail disposed between the teller control area and the customer receiving area and the assembly for moving the trays includes an electric motor mount mounted to the wall members, the electric motor having a pinion mounted to an armature thereof; and an endless strand having a tray affixed thereto, with the endless strand being trained around pulleys mounted to the wall members and the pinion, with the tray support including a slider fixably mounted to the tray and slidably mounted to the rail for movement of the tray responsive to movement of the strand when the motor is activated to thereby move the tray along the rail.

The present invention is also a modular teller station and in that regard includes a floor standing frame and a plurality of interconnected wall members that are mounted thereto to define the bank teller control area and the plurality of customer receiving areas. The tray support also includes a tray support module having a plurality of upstanding interconnected tray support wall members mounted to the frame and the wall members intermediate the teller control area and the plurality of customer receiving areas. It is preferred that the two isolation walls be disposed on the floor standing frame in an upstanding, generally parallel manner intermediate the bank control area and the plurality of customer receiving areas with the aforesaid spacing defined therebetween. Further, the tray support module may be mounted to the floor standing frame intermediate the isolation walls.

By the above, the present invention provides a modular bank teller station which provides enhanced security for the teller as well as providing the facilities to provide personal service to the customer.

DESCRIPTION OF THE PREFERRED EMBODIMENT

Figure 1:
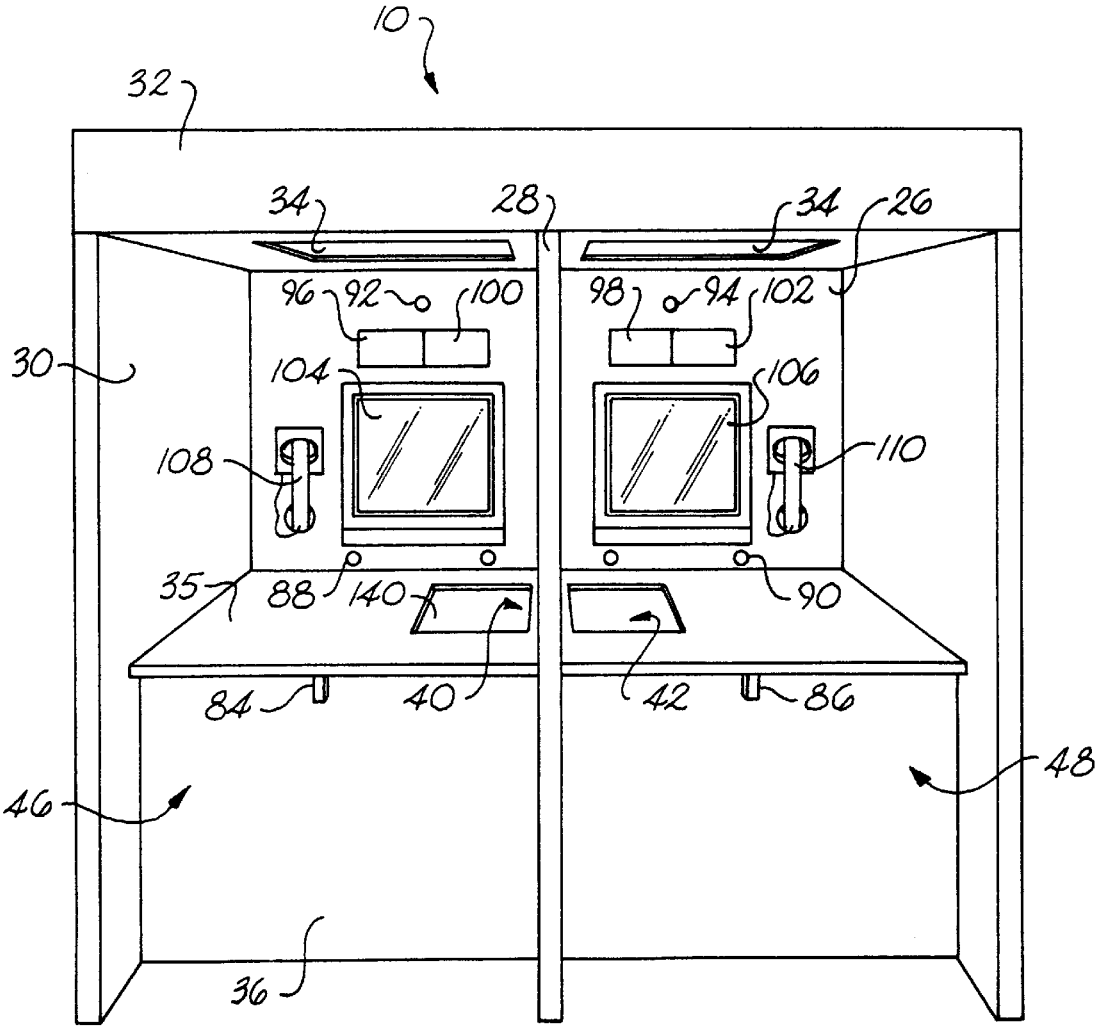
FIG. 1 is an elevational view of a bank teller station according to the preferred embodiment of the present invention illustrating the customer receiving areas.
Figure 2:
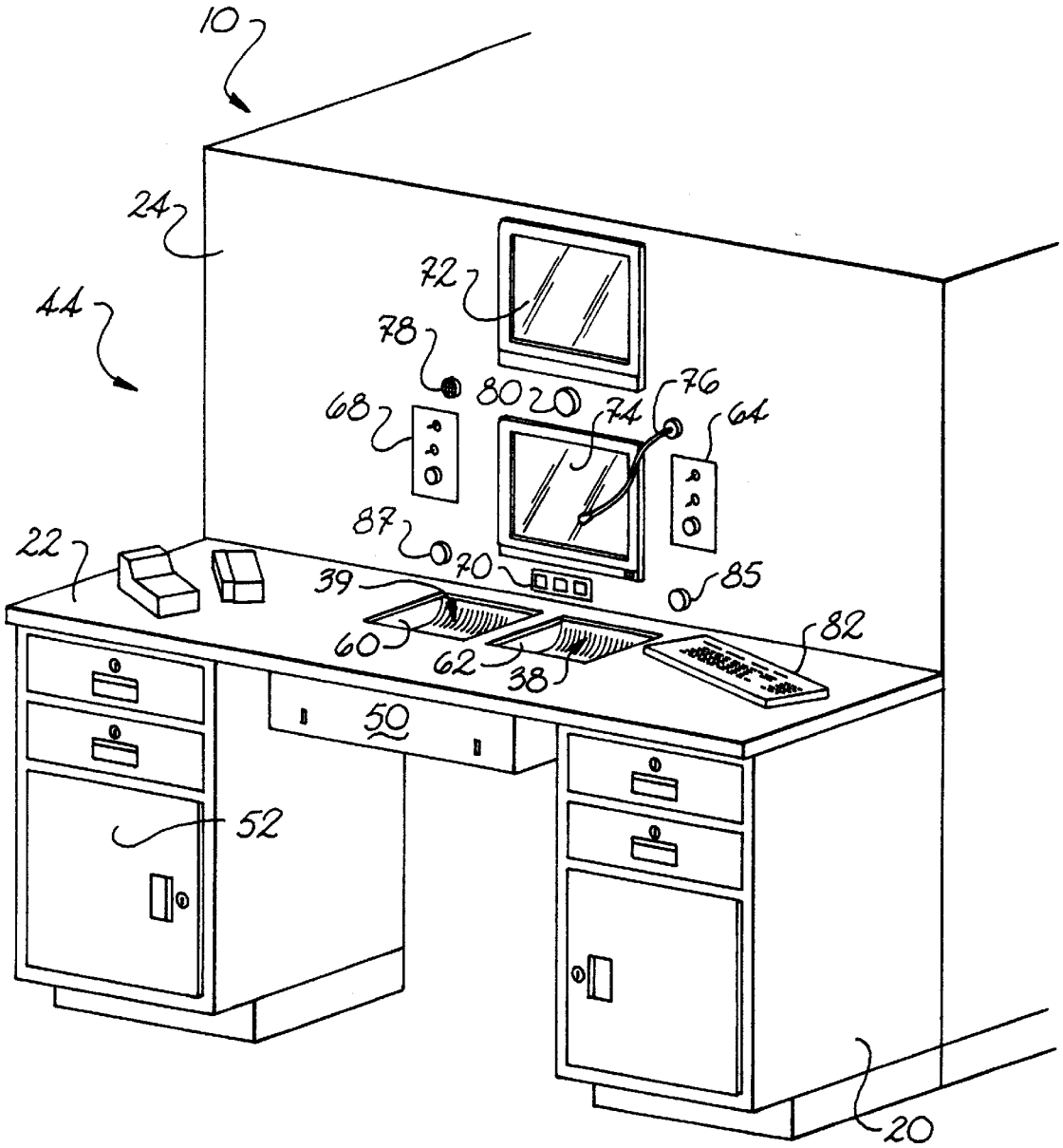
FIG. 2 is a perspective view of the bank teller station illustrated in FIG. 1 illustrating the teller control area.
Figure 3:
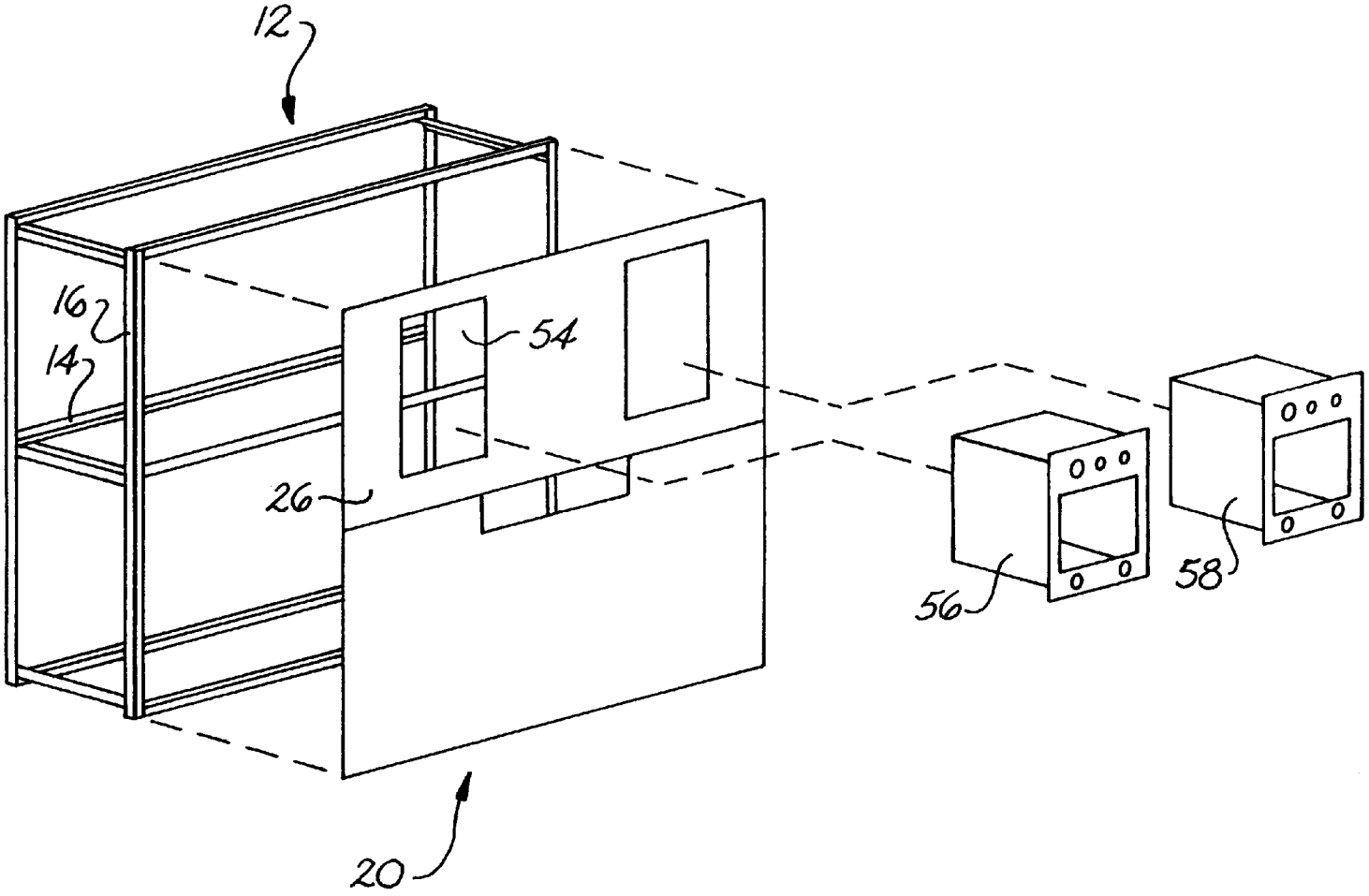
FIG. 3 is a perspective view illustrative of the frame and wall panel structure of the present invention.

Turning now to the drawings and, more particularly, to FIG. 1, a bank teller station according to the preferred embodiment of the present invention is illustrated generally at 10 and is formed as a static structure including, with additional reference to FIG. 3, a skeletal frame 12 covered in a plurality of wall panels 20. The skeletal frame 12 includes a plurality of horizontally extending cross members 14 interconnected with a plurality of vertically oriented support members 16. These are arranged to define, with reference to FIG. 2, a teller control area 44 and, with reference to FIG. 1, two customer receiving areas 46, 48. With continued reference to FIGS. 1 and 2, the teller control area 44 is disposed oppositely from and facing the customer receiving areas 46, 48 which are arranged in a side-by-side relationship. Turning now to FIG. 1, the customer receiving areas 46, 48 include upstanding side wall members 30 and an upstanding dividing wall 28 to provide privacy for the customers. A counter top 35 which is also considered a wall panel member extends intermediate the side walls 30 and the dividing wall 28 in each of the customer receiving areas 46, 48. An isolation wall 26 is provided at the innermost portion of the customer receiving areas 46, 48 and kick panels 36 are provided below the level of the counter top 35. The present invention is illustrated as including two customer receiving areas 46, 48. It should be understood, however, that the present invention is a capable of supporting multiple customer receiving areas without parting from the spirit of the scope of the present invention. The customer receiving areas 46, 48 also include several pieces of equipment for communicating with the teller. These will be explained in greater detail hereinafter. The counter top 35 in each customer receiving area includes an access opening 40, 42 for access to a movable transaction tray which will be explained in greater detail hereinafter.

Figure 4:
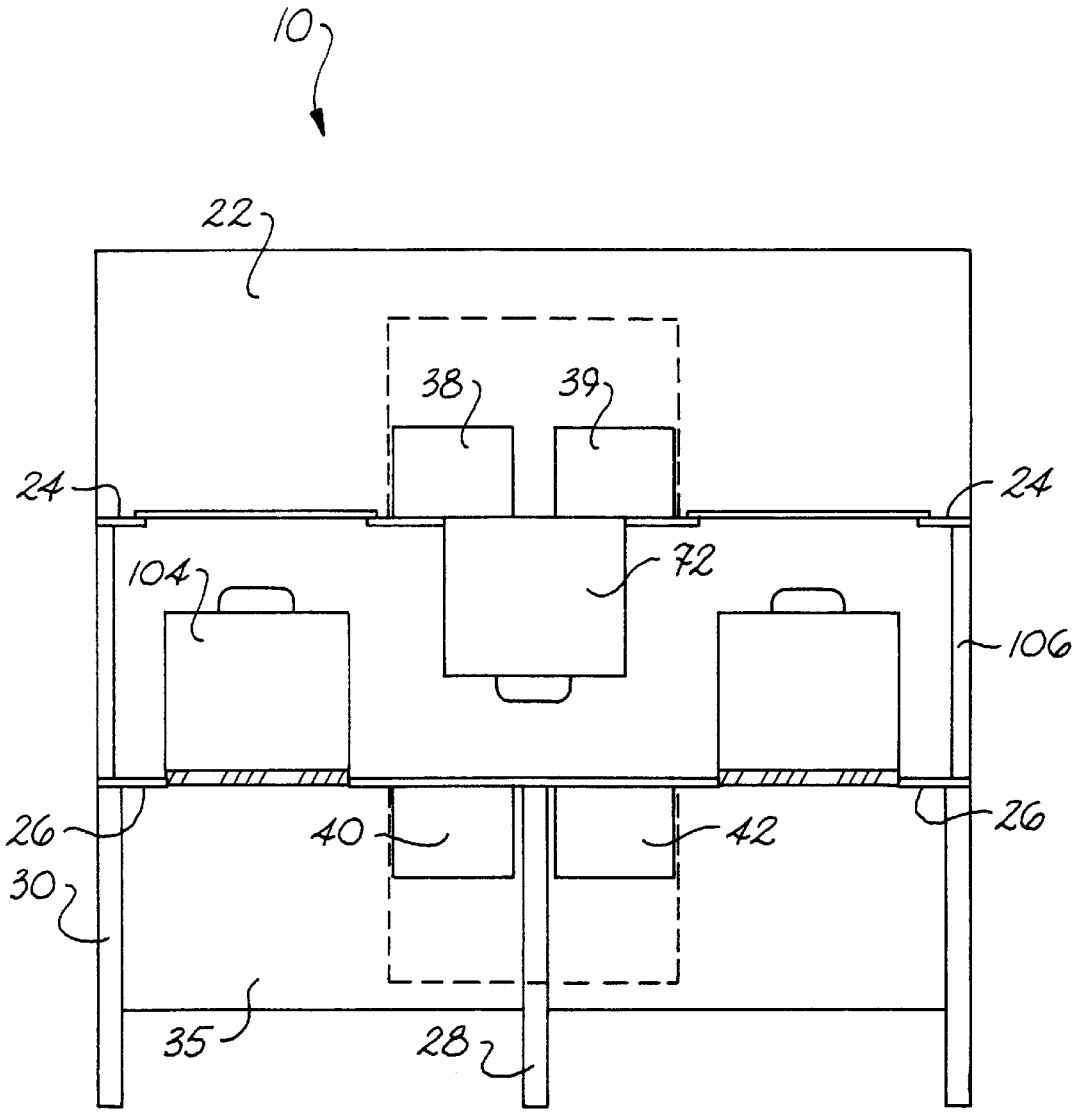
FIG. 4 is a top plan view of the bank teller station illustrated in FIG. 1.

Turning now to FIG. 2, the teller station includes an isolation wall 24 which is separate from the isolation wall 26 associated with the customer receiving areas 46, 48. The separation arrangement is best seen in FIG. 4. With both isolation walls 24, 26 being formed from bullet resistant material, the teller at the teller control area enjoys a heretofore unknown level of security.

Returning to FIG. 2, the teller control area 44 also includes a counter top 22 and, underneath the counter top 22, an arrangement of drawers 50 and cabinets 52. The counter top 22 includes two access openings 38, 39 for access to two transaction trays 60, 62. The access openings 38, 39 are arranged in a side-by-side manner. Other items associated with the communication system are mounted to the isolation wall 24, but will be explained in greater detail hereinafter.

Figure 6:
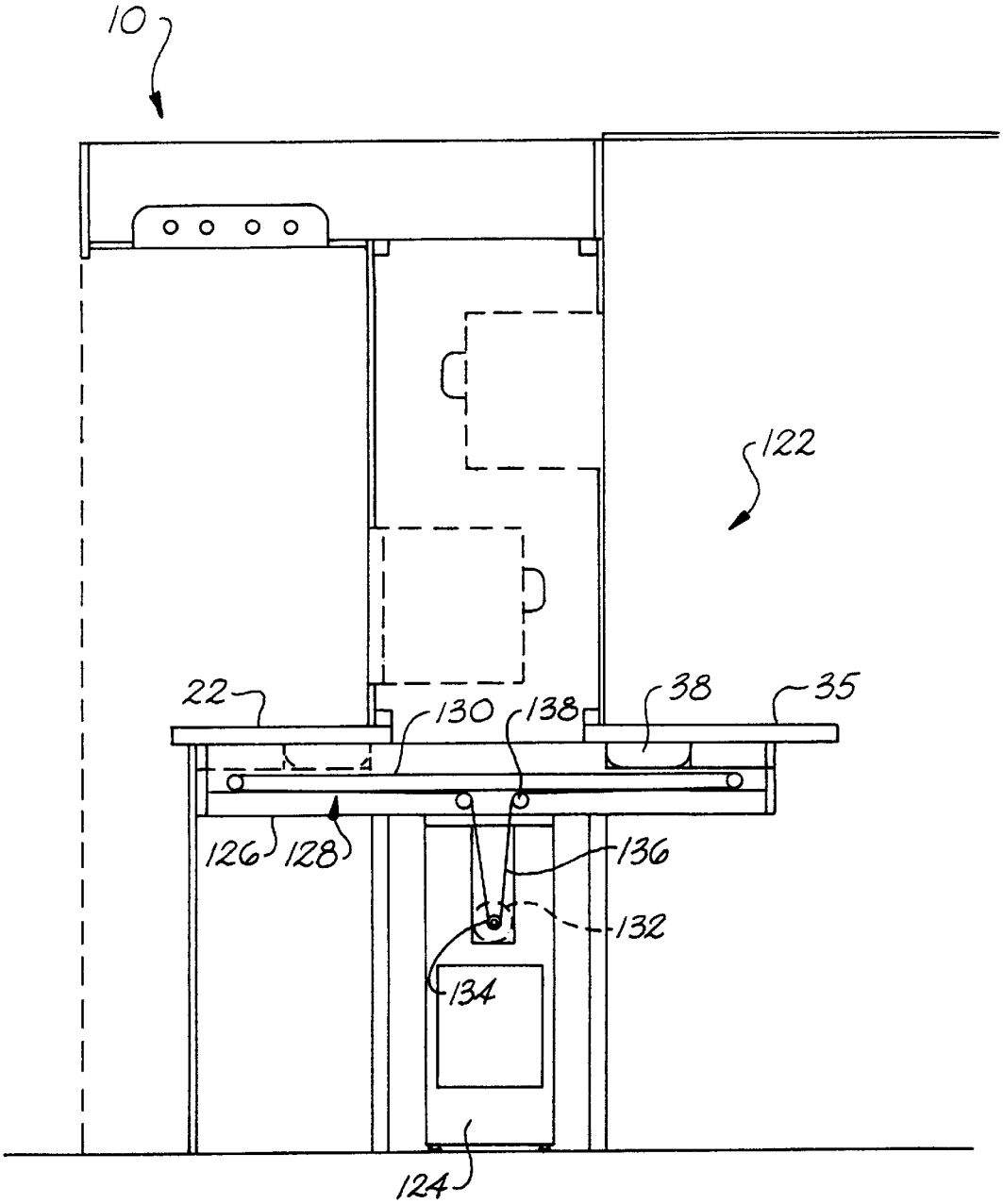
FIG. 6 is a side view of the teller control station open to illustrate the tray support module.

As previously explained, the present invention is formed as a modular structure with the plurality of wall panels 20 fixed to a skeletal frame structure 12 as seen in FIG. 3. Additionally, the customer receiving area isolation wall 26, also illustrated in FIG. 3 includes two openings 54 arranged in a side-by-side manner for receiving monitors 56, 58. Two monitor pods 56, 58 may be fitted within the openings 54 and the customer receiving area isolation wall 26. This construction is typical of the entire teller station 10 and the modular construction can also be seen in FIG. 4. As seen in FIG. 6, and as will be explored in greater detail hereinafter, the tray support system is also a modular structure illustrated generally at 122. Therefore, the entire teller station 10 may be assembled as a stand alone unit which is completely secure from the customer receiving area side. The modular unit may be placed within a building, such as a bank, or even a grocery store or drug store as is becoming more popular with banks.

Figure 5:
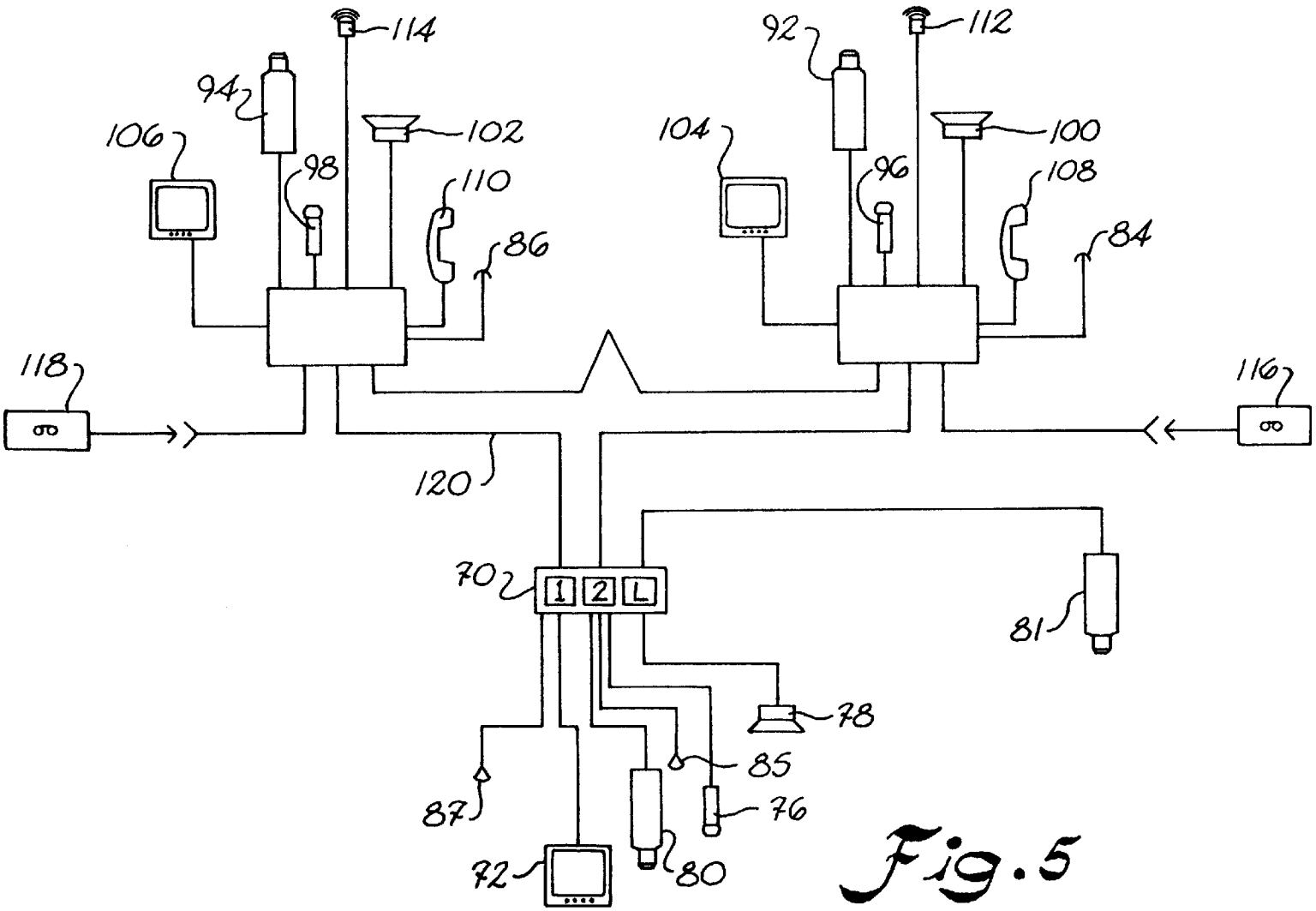
FIG. 5 is a diagrammatic view of the communication system of the present invention.

The communication system is illustrated generally in FIG. 5 and the specific components thereof may be seen in FIGS. 1 and 2 in their respective locations in the teller area 44 and the customer receiving areas 46, 48. The general idea is to provide complete communication between the teller and the customers and a commensurate level of personal service. In that regard, the teller at the teller area 44 is alerted to the presence of the customers using proximity sensors 84, 86 which are disposed underneath the counter top 35 and the customer receiving areas 46, 48 as seen in FIG. 1 and FIG. 5. The proximity sensors 84, 86 are connected to lamps 85, 87 in the teller control area 44 such that upon the approach of a customer into a customer receiving area 46, 48, the proximity sensors will detect the customer and light the respective lamps 85, 87 to indicate to the teller the presence of a customer at one of the customer receiving areas 46, 48. Each customer receiving area 46, 48 also includes a video camera 92, 94 selectively connected to a monitor 72 disposed in the teller area 44. An indicator panel 70 disposed on the teller isolation wall 24 is provided to indicate to the teller the source of the video feed appearing on the monitor 72. Similarly, the teller control area 44 includes a camera 80 which is connected to monitors 104, 106 which are disposed in the respective customer receiving areas 46, 48. The teller control area 44 also includes a microphone 76 which is connected to speakers 100, 102 disposed in the customer receiving areas 46, 48. A camera 81 may also be provided for lobby monitoring and control of the cameras lies with the teller. Hand sets 108, 110 are provided at the respective customer receiving areas 46, 48 for more private conversations between the teller and the customer. Finally, optional video players 116, 118 are connected to the respective customer receiving areas 46, 48 so that promotional videos or other designated videos may be played for the customer while waiting for the transaction to take place. All of the communications equipment is connected by conventional wiring 120. With reference to FIG. 2, the teller has the tray access openings 38, 39 in the counter top 22 directly in front of the teller. The isolation wall 26 includes two monitors 72, 74 which may be selectively arranged for viewing either customer or the lobby. Control panels 64, 68 provide the necessary switches for controlling the transaction. Similarly, on the customer side, all of the controls and communications gear are mounted on the isolation wall 26 facing a customer. As seen in FIGS. 1 and 2, the arrangement of the controls is ergonomically designed.

One of the important aspects of the present invention is the transaction transfer system illustrated generally at 122 in FIG. 6. A pair of shallow trays 60, 62 is movably mounted within the teller station 10 to exchange transaction material between the teller and a customer. The system is modular, compact and provides a short travel distance between the teller and the customer to speed up the transaction process. Further, the present invention provides unique cover members which move in and out of covering relation with the access openings and the counter tops to prevent the insertion of foreign material or weapons into the transport system. Additionally, according to the preferred embodiment of the present invention, the controls only allow the trays to be moved away from either the customer or the teller, i.e. a "send" mode. Neither the teller nor the customer can retrieve a tray once it is sent away. This satisfies a safety concern that someone could have their hand in a tray when someone on the other side of the wall retracted the tray, thereby possibly causing injury. Nevertheless, such a requirement is not vital to the present invention and the ability to retract a tray is well within the scope of the present invention.

Figure 8:
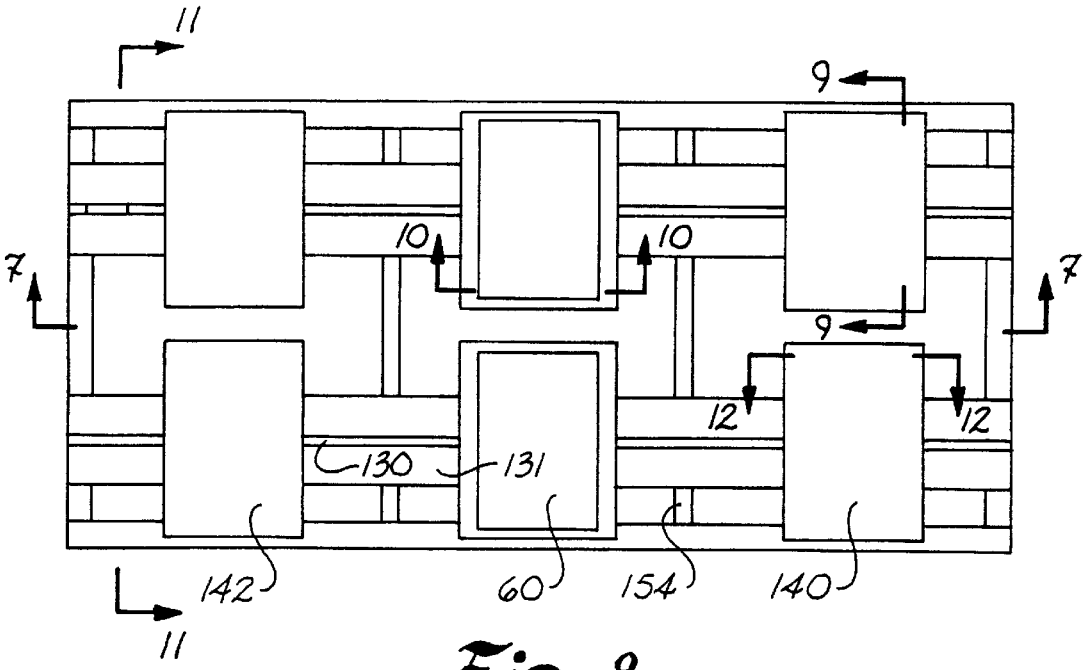
FIG. 8 is a plan view of the tray support module.

FIG. 6 illustrates the transaction transfer system 122 in relation to the remainder of the teller station 10. The transaction transfer system 122 is modular and T-shaped in cross section. The vertical portion of the "T" is formed as a floor standing support housing 124 having a longitudinally extending track housing 126, defining therein a track chamber 128 disposed thereon. As seen in FIG. 8, a plurality of cross members 154 is provided for support of the trays 60, 62.

Figure 7:
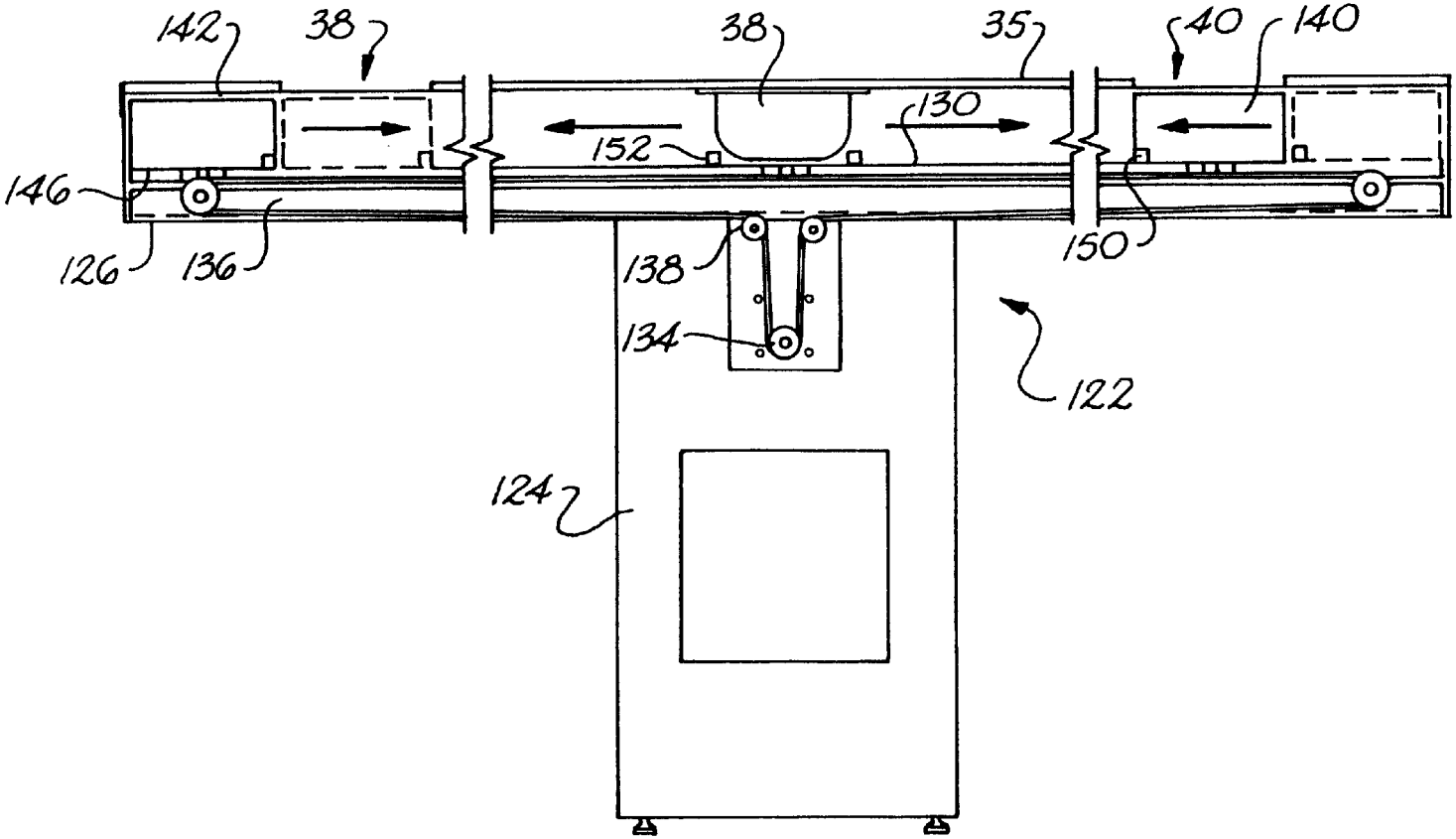
FIG. 7 is a cut-away view of the tray support module taken along lines 7—7 in FIG. 8.
Figure 9:
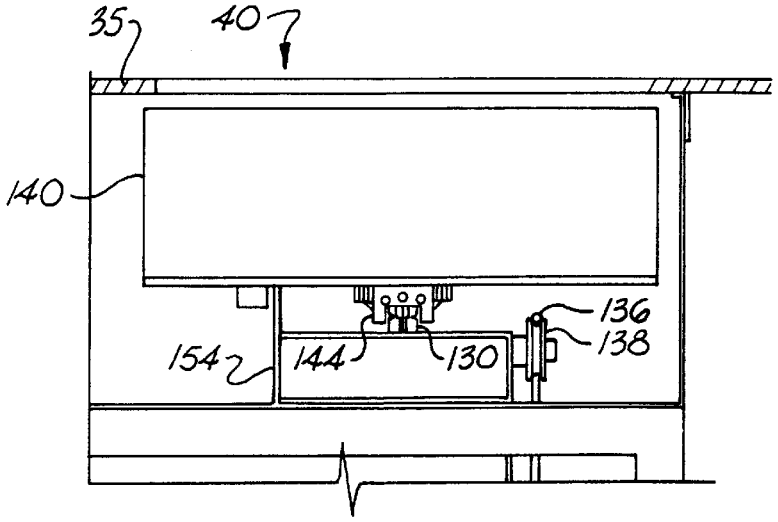
FIG. 9 is a cut away view of a portion of the tray support module taken along lines 9—9 in FIG. 8.
Figure 10:
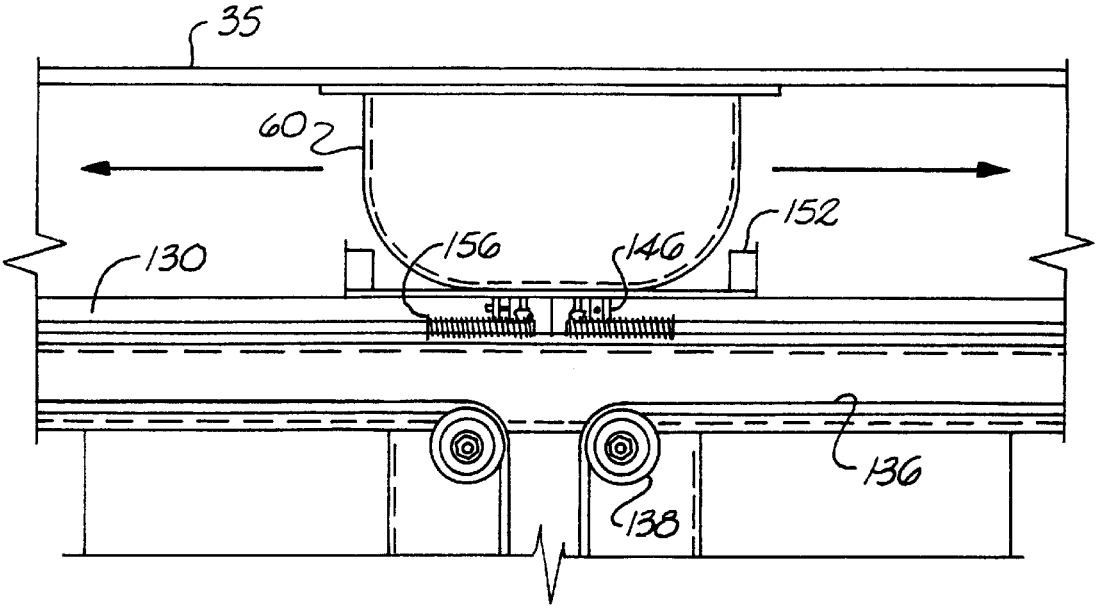
FIG. 10 is a cut-away partial view of the tray support module taken along line 10—10 in FIG. 8.
Figure 11:
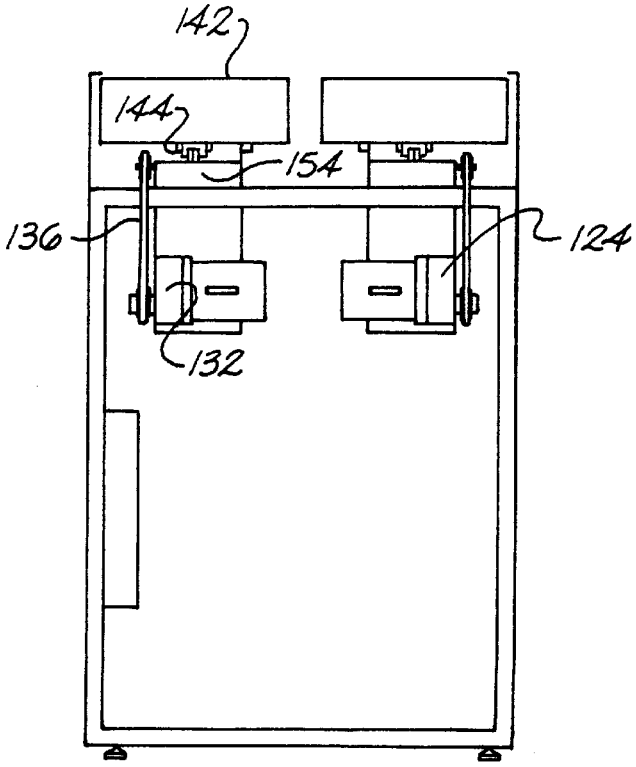
FIG. 11 is a cut-away view of a portion of the tray support module taken along line 11—11 in FIG. 8.

The trays 60, 62 are driven by a belt or strand drive which includes an electric motor 132 mounted to the support module 124 with the electric motor including a pinion 134 on an armature thereof, as is known generally for belt or strand drive systems. A plurality of pulleys 138 are arranged in a pattern throughout the track chamber 128 to define a path through which the endless strand 136 travels. As seen in FIGS. 9 and 10, each tray 60, 62 rides on a slider 144 which is disposed on a longitudinally extending rail 130 which extends between the customer receiving areas 46, 48 and the teller area 44. As seen in FIG. 8, there are two separate drive systems including the rail 130, and a rail support 131 extending below in supporting relation with the rails 130. As seen in FIGS. 7 and 9, the trays 60, 62 are accompanied on the rails 130 by a plurality of cover members 140 which are essentially aluminum boxes, each mounted to a slider 144 as seen in FIG. 9. The cover members 140 are displaceable, in a manner which will be seen in greater detail hereinafter, by the tray 60 as it moves in and out of association with the access openings 38, 39, 40, 42. As seen in FIGS. 6 and FIG. 10 the centrally located motor 132 drives a belt 136 from a central location disposed below the track chamber 128. A motor 124, 132 is provided for each tray drive, as seen in FIG. 11. Referring to FIG. 10, springs 156 are provided on either side of the slider 146 associated with the tray 60 to act as bumpers. The motor 132 is controlled by either the teller or the customer to initiate movement of the strand which will move the sliders and whatever is attached thereto.

Figure 12:
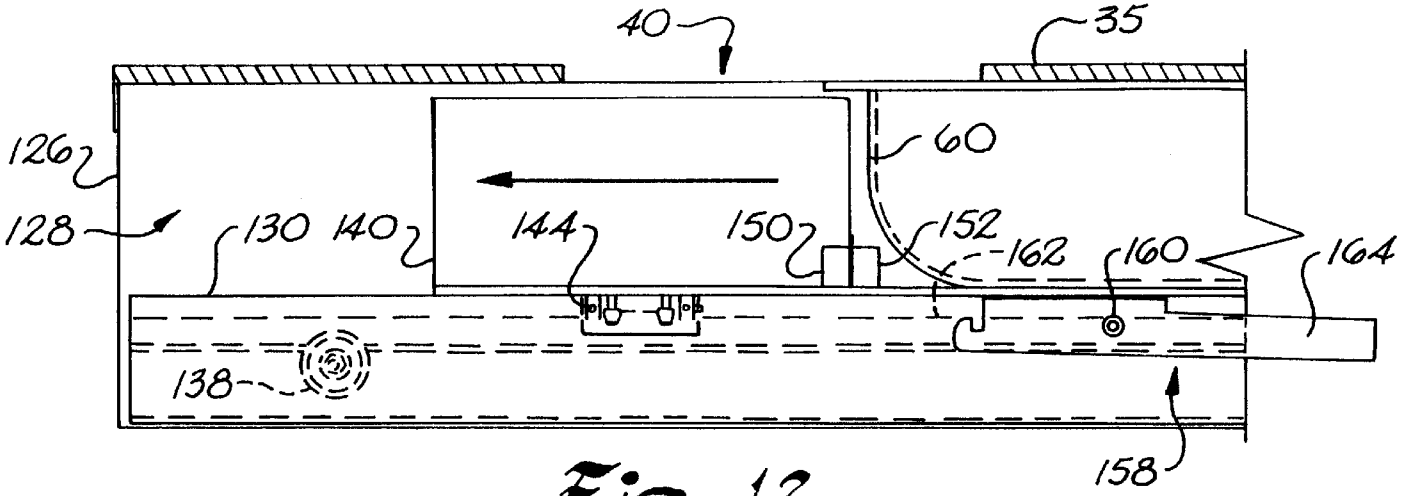
FIG. 12 is a partial cut-away view of a portion of the tray support module taken along lines 12—12 in FIG. 8 illustrating a first position of a cover member control arm.
Figure 13:
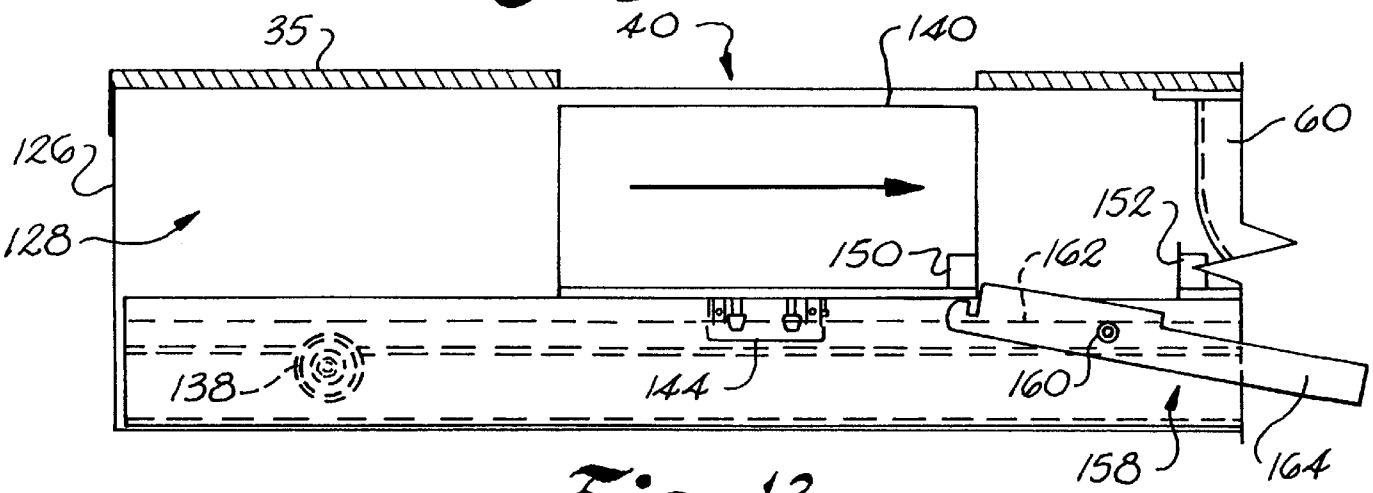
FIG. 13 is a cut-away view of the tray support module illustrated in FIG. 12 illustrating a second position of the cover member control arm.

As seen in FIG. 8, each tray 60 is disposed intermediate two cover members 140, 142 which are displaceable thereby. This action is best seen in FIGS. 12 and 13. As also illustrated in FIGS. 12 and 13, a cover member control arm 158 is mounted at a pivot 160 to the rail support and the arm 158 includes a latching surface 162 and a biasing weight portion 164 to allow the cover member control arm 158 to naturally be biased upwardly into the path of movement associated with the tray 60 and the cover members 140, 142. Magnets 152 are mounted to the tray on either end thereof and corresponding magnets 150 are mounted to the cover members 140, 142. The magnets 150, 152 are mounted to each respective support at a location so that they may be in contact when the respective supports are in contact. In FIG. 12, the tray 60 has arrived over the cover member control arm 158 and has biased the arm into a level relationship underneath the tray 60. The magnets 150, 152 attract and connect the cover member 140 with the tray 60 such that they slide together as a unit. The tray then moves underneath the access opening 40 which acts to drive the cover member 140 rearwardly away from the access opening 40, where it remains attached to the tray 60. When the tray is withdrawn, the biasing weight 164 causes the arm to pivot at the pivot point 160 which raises the latching surface 162 into a blocking relationship with the cover member 140 which is being withdrawn along with the tray 60 as seen in FIG. 13. Abutment of the cover member 140 with the latching surface 162 of the cover member control arm 158 causes the cover member 140 to remain stationary underneath the access opening 40 while the transaction tray 60 continues along its path. In this manner, the access openings 38, 39, 40, 42 are automatically covered and uncovered during the ongoing transaction process.

In operation, a customer will approach the customer receiving area as seen in FIG. 1 where the proximity sensor 84 will detect the presence of the customer and alert the teller using a light or other sensory signal. The teller will respond by appearing on the monitor and verbally transacting business with the customer through the speakers and microphone arrangements. If, for example, the customer is making a deposit, the teller will send a tray 60 through the tray chamber 128 toward the access opening 40 at the customer receiving area. The customer will replace the transaction materials within the tray 60 and then activate the send button which will act to return the tray 60 to the teller control area 44. There, in a manner previously described, the tray 60 will displace the cover member 140 and allow the customer access to the tray 60. Once the customer is finished, the customer will send the tray back to the teller, and, in a manner previously described, the cover member will return to covering relation with the access opening 40. During these operations the teller may selectively observe the customer on the monitor 74 or may choose to view action in the lobby through the lobby camera 81 and the teller may select whichever video feed is desirable.

By the above, the present invention provides a secure teller station which is modular and may be adapted to many different circumstances as required.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A bank teller station wherein a single bank teller can provide banking services to a plurality of banking customers with said bank teller station providing enhanced security for the bank teller, said bank teller station comprising:

a plurality of interconnected wall members defining a bank teller control area and a plurality of customer receiving areas, said wall members including at least one isolation wall member disposed intermediate said bank teller control area and said plurality of customer receiving areas to thereby isolate said teller control area from said plurality of customer receiving areas;

means for enabling communication between a teller at said teller control area and a customer at one of said plurality of customer receiving areas, said communication enabling means being mounted to said wall members;

at least one tray support mounted to said wall members intermediate said teller control area and said plurality of customer receiving areas;

a plurality of transaction trays corresponding in number to said plurality of customer receiving areas, said transaction trays being movably disposed on said tray support for controlled movement between a first position at said teller control area and a second position at a respective one of said plurality of customer receiving areas to allow the interchange of transactional material between said bank teller control area and said plurality of customer receiving areas, said at least one isolation wall member having a first access opening formed therein at said bank teller control area and a second access opening formed therein at each said customer receiving area with each said second access opening being in communication with a respective transaction tray;

means for moving said transaction trays between said first position at said teller control area and said second position at a respective one of said plurality of customer receiving areas, said means for moving said transaction trays being disposed within the confines of said wall members;

a plurality of cover members moveably mounted to said teller station at said access openings, said cover members being selectively movable in and out of covering relation with said access openings;

means for moving said cover members in and out of covering relation with said access openings mounted to said wall members adjacent said access openings, wherein said means for moving said cover members includes means for connecting a respective one of said cover members to a respective transaction tray for simultaneous movement thereof to move each said cover member into and out of covering relation with each said access opening and an arm pivotally mounted to said tray support adjacent each said access opening, said arm being displaceable by one of said transaction trays as said transaction tray attains a predetermined distance from said access opening for said arm to abut said cover member and disengage said cover member from said transaction tray, thereby leaving said cover member in covering relation with a respective one of said access openings; and means for selectively controlling movement of said transaction trays, said means for selectively controlling movement being mounted to said teller station at said teller control area and operable therefrom.

2. A bank teller station according to claim 1 wherein said wall members define two customer receiving areas disposed adjacent one another in facing relation with said teller control area and separated therefrom by said at least one isolation wall member and being isolated from one another by a customer isolation wall disposed intermediate said customer receiving areas.

3. A bank teller station according to claim 1 wherein said at least one isolation wall member is resistant to penetration by bullets.

4. A bank teller station according to claim 3 wherein said bank teller station includes at least two isolation walls, both said isolation walls being disposed intermediate said bank teller control area and said plurality of customer receiving areas with a spacing defined between said isolation walls to thereby further isolate said teller control area from said plurality of customer receiving areas.

5. A bank teller station according to claim 1 and further comprising means disposed in said customer receiving areas to alert a teller at said teller control area.

6. A bank teller station according to claim 1 wherein said means for enabling communication between a teller at said teller control area and a customer in one of said plurality of customer receiving areas includes a teller voice communication device disposed at said teller control area and a plurality of customer voice communication devices, each of said plurality being disposed at a respective one of said customer receiving areas, said teller voice communication device being in communication with each of said customer voice communication devices for selective voice communication between a teller and a customer.

7. A bank teller station according to claim 6 wherein said means for enabling communication between a teller at said teller control area and a customer in one of said plurality of customer receiving areas includes a teller camera disposed in said teller control area and a plurality of monitors in communication with said teller camera, with one of said plurality of monitors being disposed at a respective one of said plurality of customer receiving areas for viewing of a teller by a customer.

8. A bank teller station according to claim 7 wherein said means for enabling communication between a teller at said teller control area and a customer in one of said plurality of customer receiving areas includes a plurality of customer cameras, with each of said plurality of cameras being disposed in a respective one of said customer receiving areas, and at least one monitor in communication with said customer cameras, with said at least one monitor being disposed at said teller control area for viewing a customer by a teller.

9. A bank teller station according to claim 1 wherein said tray support includes at least one rail extending between said access openings and said transaction trays are slidably mounted to said at least one rail.

10. A bank teller station according to claim 9 wherein said means for moving said transaction trays between said first position at said teller control area and said second position at a respective one of said plurality of customer receiving areas includes a plurality of endless strand members, each attached to a respective one of said plurality of trays, and means for individually moving said plurality of endless strand members and thereby individually moving said transaction trays.

11. A bank teller station according to claim 10 wherein said means for moving said transaction trays includes at least one electric motor in mechanical communication with said strand members so that excitement of said at least one electric motor causes movement of at least one of said endless strand members, said at least one electric motor being selectively operable for selective movement of said transaction trays.

12. A bank teller station according to claim 11 wherein said means for selectively controlling movement of said transaction trays includes a motor activation switch disposed at said teller control area in electrical communication with said at least one electric motor for teller initiated movement of said transaction trays.

13. A bank teller station according to claim 1 wherein said tray support includes at least one longitudinally extending rail disposed between said teller control area and said customer receiving areas and said means for moving said trays includes an electric motor mounted to said wall members, said electric motor having a pinion mounted to an armature thereof; and an endless strand having a tray affixed thereto, with said endless strand being trained around pulleys mounted to said wall members and said pinion, and said tray support includes a slider fixedly mounted to said tray and slidably mounted to said rail, for movement of said tray responsive to movement of said strand when said motor is activated to thereby move said tray along said rail.

14. A bank teller station wherein a single bank teller can provide banking services to a plurality of banking customers with said bank teller station providing enhanced security for the bank teller, and wherein said teller station can be installed in banking facilities as a modular unit, said bank teller station comprising:

a floor standing frame and a plurality of interconnected wall members mounted thereto and defining a bank teller control area and a plurality of customer receiving areas, said wall members including at least one isolation wall member disposed intermediate said bank teller control area and said plurality of customer receiving areas to thereby isolate said teller control area from said plurality of customer receiving areas, said floor standing frame and said wall members defining a modular teller station unit that can be moved as a unit and installed in a banking facility as a unit;

means for enabling communication between a teller at said teller control area and a customer at one of said plurality of customer receiving areas, said communication enabling means being mounted to said wall members;

at least one tray support module having a plurality of upstanding interconnected tray support wall members mounted to said floor standing frame and said wall members intermediate said teller control area and said plurality of customer receiving areas;

a plurality of transaction trays corresponding in number to said plurality of customer receiving areas, said transaction trays being movably disposed on said tray support module for controlled movement between a first position at said teller control area and a second position at a respective one of said plurality of customer receiving areas to allow the interchange of transactional material between said bank teller control area and said plurality of customer receiving areas, said at least one isolation wall member having a first access opening formed therein at said bank teller control area and a second access opening formed therein at each said customer receiving area, with each said second access opening being in communication with a respective transaction tray;

means for moving said transaction trays between said first position at said teller control area and said second position at a respective one of said plurality of customer receiving areas, said means for moving said transaction trays being mounted to said tray support module;

a plurality of cover members moveably mounted to said wall members at said access openings, said cover members being selectively movable in and out of covering relation with said access openings;

means for moving said cover members in and out of covering relation with said access openings mounted to said wall members, wherein said means for moving said cover members includes means for connecting a respective one of said cover members to a respective transaction tray for simultaneous movement thereof to move each said cover member into and out of covering relation with each said access opening and an arm pivotally mounted to said tray support module adjacent each said access opening, said arm being displaceable by one of said transaction trays as said transaction tray attains a predetermined distance from said access opening for said arm to abut said cover member and disengage said cover member from said transaction tray, thereby leaving said cover member in covering relation with a respective one of said access openings; and means for selectively controlling movement of said transaction trays, said means for selectively controlling movement being mounted to said wall members at said teller control area and operable therefrom.

15. A bank teller station according to claim 14 wherein said wall members define two customer receiving areas disposed adjacent one another in facing relation with said teller control area and separated therefrom by said at least one isolation wall member and being isolated from one another by a customer isolation wall disposed intermediate said customer receiving areas.

16. A bank teller station according to claim 14 wherein said at least one isolation wall member is resistant to penetration by bullets.

17. A bank teller station according to claim 14 wherein said bank teller station includes at least two isolation walls, both said isolation walls being disposed on said floor standing frame in an upstanding, generally parallel manner intermediate said bank teller control area and said plurality of customer receiving areas with a spacing defined between said isolation walls to thereby further isolate said teller control area from said plurality of customer receiving areas.

18. A bank teller station according to claim 17 wherein said tray support module is mounted to said floor standing frame intermediate said isolation walls.

19. A bank teller station according to claim 14 and further comprising means disposed in said customer receiving areas to alert a teller at said teller control area.

20. A bank teller station according to claim 14 wherein said means for enabling communication between a teller at said teller control area and a customer in one of said plurality of customer receiving areas includes a teller voice communication device disposed at said teller control area and a plurality of customer voice communication devices, each of said plurality being disposed at a respective one of said customer receiving areas, said teller voice communication device being in communication with each of said customer voice communication devices for selective voice communication between a teller and a customer.

21. A bank teller station according to claim 20 wherein said means for enabling communication between a teller at said teller control area and a customer in one of said plurality of customer receiving areas includes a teller camera disposed in said teller control area and a plurality of monitors in communication with said teller camera, with one of said plurality of monitors being disposed at a respective one of said plurality of customer receiving areas for viewing of a teller by a customer.

22. A bank teller station according to claim 21 wherein said means for enabling communication between a teller at said teller control area and a customer in one of said plurality of customer receiving areas includes a plurality of customer cameras, with each of said plurality of cameras being disposed in a respective one of said customer receiving areas, and at least one monitor in communication with said customer cameras, with said at least one monitor being disposed at said teller control area for viewing a customer by a teller.

23. A bank teller station according to claim 14 wherein said tray support module includes at least one rail extending between said access openings and said transaction trays are slidably mounted to said at least one rail.

24. A bank teller station according to claim 23 wherein said means for moving said transaction trays between said first position at said teller control area and said second position at a respective one of said plurality of customer receiving areas includes a plurality of endless strand members, each attached to a respective one of said plurality of trays, and means for individually moving said plurality of endless strand members and thereby individually moving said transaction trays.

25. A bank teller station according to claim 24 wherein said means for moving said transaction trays includes at least one electric motor mounted to said tray support module in mechanical communication with said endless strand members so that excitement of said at least one electric motor causes movement of at least one of said endless strand members, said at least one electric motor being selectively operable for selective movement of said transaction trays.

26. A bank teller station according to claim 25 wherein said means for selectively controlling movement of said transaction trays includes a motor activation switch disposed at said teller control area in electrical communication with said at least one electric motor for teller initiated movement of said transaction trays.

27. A bank teller station according to claim 14 wherein said tray support module includes at least one longitudinally extending rail disposed between said teller control area and said customer receiving areas and said means for moving said trays includes an electric motor mounted to said wall members, said electric motor having a pinion mounted to an armature thereof; and an endless strand having a tray affixed thereto, with said endless strand being trained around pulleys mounted to said wall members and said pinion, and said tray support module includes a slider fixedly mounted to said tray and slidably mounted to said rail, for movement of said tray responsive to movement of said strand when said motor is activated to thereby move said tray along said rail.

28. A bank teller station wherein a single bank teller can provide banking services to a plurality of banking customers with said bank teller station providing enhanced security for the bank teller, said bank teller station comprising:

a plurality of interconnected wall members defining a bank teller control area and two customer receiving areas, said wall members including two isolation walls, both said isolation walls being resistant to penetration by bullets and disposed intermediate said bank teller control area and a plurality of customer receiving areas with a spacing defined between said isolation walls to thereby further isolate said teller control area from said plurality of customer receiving areas;

means for enabling communication between a teller at said teller control area and a customer at one of said plurality of customer receiving areas, said communication enabling means being mounted to said wall members and including a teller voice communication device disposed at said teller control area and two customer voice communication devices, each said customer voice communication device being disposed at a respective one of said customer receiving areas, said teller voice communication device being in communication with each of said customer voice communication devices for selective voice communication between a teller and a customer, and including at least two customer cameras, with each of said cameras being disposed in a respective one of said customer receiving areas, and at least one monitor in communication with said customer cameras, with said at least one monitor being disposed at said teller control area for viewing a customer by a teller;

two tray supports, each including at least one longitudinally extending rail member mounted to said wall members intermediate said teller control area and said customer receiving areas;

two transaction trays, each being movably disposed on a respective one of said tray supports for controlled movement between a first position at said teller control area and a second position at a respective one of said customer receiving areas to allow the interchange of transactional material between said bank teller control area and said customer receiving areas, said isolation wall members having a first access opening formed therein at said bank teller control area and a second access opening formed therein at each said customer receiving area, with each said second access opening being in communication with a respective transaction tray;

means for moving said transaction trays between said first position at said teller control area and said second position at a respective one of said customer receiving areas, said means for moving said transaction trays including a plurality of endless strand members, each attached to a respective one of said trays, and means for individually moving said plurality of endless strand members and thereby individually moving said transaction trays and at least one electric motor mounted to said wall members in mechanical communication with said endless strand members so that excitement of said at least one electric motor causes movement of at least one of said endless strand members, said at least one electric motor being selectively operable for selective movement of said transaction trays;

a plurality of cover members moveably mounted to said wall members at said access openings, said cover members being selectively movable in and out of covering relation with said access openings;

means for moving said cover members in and out of covering relation with said access openings mounted to said wall members adjacent said access openings and including means for connecting a respective one of said cover members to a respective transaction tray for simultaneous movement thereof to move each said cover member into and out of covering relation with each said access opening and an arm pivotally mounted to said tray support adjacent each said access opening, said arm being displaceable by one of said transaction trays as said transaction tray attains a predetermined distance from said access opening for said arm to abut said cover member and disengage said cover member from said transaction tray, thereby leaving said cover member in covering relation with a respective one of said access openings; and means for selectively controlling movement of said transaction trays, said means for selectively controlling movement including a motor activation switch disposed at said teller control area in electrical communication with said at least one electric motor for teller initiated movement of said transaction trays.

29. A bank teller station according to claim 28 and further comprising a floor standing frame having said plurality of interconnected wall members mounted thereto to further define a bank teller control area and two customer receiving areas, said floor standing frame and said wall members defining a modular teller station unit that can be moved as a unit and installed in a banking facility as a unit.

30. A bank teller station according to claim 29 and further comprising a tray support module mounted to said floor standing frame to provide support for said transaction trays, said tray supports and said means for moving said trays.

* * * * *